US011994002B1

(12) United States Patent
Taha

(10) Patent No.: US 11,994,002 B1
(45) Date of Patent: May 28, 2024

(54) CONTROLLING A WELLBORE FLUID FLOW

(71) Applicant: Saudi Arabian Oil Company, Dhahran (SA)

(72) Inventor: Syed Muhammad Bin Syed Taha, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/115,399

(22) Filed: Feb. 28, 2023

(51) Int. Cl.
*E21B 34/06* (2006.01)
*E21B 34/08* (2006.01)

(52) U.S. Cl.
CPC ..... *E21B 34/063* (2013.01); *E21B 34/08* (2013.01)

(58) Field of Classification Search
CPC ..... E21B 34/063; E21B 34/08
See application file for complete search history.

(56) References Cited

U.S. PATENT DOCUMENTS

| | | | | |
|---|---|---|---|---|
| 3,051,243 | A | 8/1962 | Grimmer | |
| 3,749,119 | A | 7/1973 | Watkins | |
| 4,009,753 | A | 3/1977 | McGill et al. | |
| 4,043,392 | A | 8/1977 | Gazda | |
| 4,340,259 | A | 7/1982 | Green | |
| 4,688,593 | A * | 8/1987 | Pringle | E21B 34/102 166/317 |
| 4,723,606 | A | 2/1988 | Vinzant | |
| 4,813,481 | A | 3/1989 | Sproul et al. | |
| 4,846,281 | A | 7/1989 | Clary | |
| 5,263,683 | A | 11/1993 | Wong | |
| 5,823,265 | A | 10/1998 | Crow | |
| 6,808,020 | B2 | 10/2004 | Garcia | |
| 7,252,153 | B2 | 8/2007 | Hejl | |
| 7,665,528 | B2 | 2/2010 | Ross et al. | |

(Continued)

FOREIGN PATENT DOCUMENTS

| | | |
|---|---|---|
| EP | 2142755 | 3/2016 |
| GB | 2257185 | 1/1993 |
| GB | 2452370 | 3/2009 |

OTHER PUBLICATIONS

Afolabi et al., "Application of Intelligent Completion Solution in a Marginal Field-Okporhuru Field Case Study, Onshore Niger Delta," SPE-178756-MS, Society of Petroleum Engineers, Aug. 2015, 8 pages.

*Primary Examiner* — James G Sayre
(74) *Attorney, Agent, or Firm* — Fish & Richardson P.C.

(57) ABSTRACT

A valve assembly and a method for controlling a wellbore fluid flow. The valve assembly includes a tubular having an outer surface and an inner surface. The inner surface defines a void. Multiple flow paths paths extend from the inner surface to the outer surface. A flow tube is slideably coupled to the outer surface and movable between a first position preventing a flow of fluid through the flow paths and a second position allowing the flow of fluid through the flow paths. An actuator sub-assembly is operably coupled to the flow tube. The actuator sub-assembly is configured to actuate the flow tube from the first position to the second position responsive to a differential pressure greater than or equal to a threshold differential pressure. The actuator sub-assembly includes a pressure cartridge, a burst disc, a retention shear ring, a retraction power spring, and a pressure chamber.

14 Claims, 2 Drawing Sheets

(56) References Cited

U.S. PATENT DOCUMENTS

| | | | |
|---|---|---|---|
| 8,424,611 | B2 | 4/2013 | Smith |
| 9,476,262 | B2 | 10/2016 | Benson et al. |
| 11,459,852 | B2 | 10/2022 | Taha |
| 2002/0079104 | A1 | 6/2002 | Garcia |
| 2002/0134551 | A1 | 9/2002 | Pringle |
| 2004/0065442 | A1 | 4/2004 | Myerley |
| 2006/0124315 | A1 | 6/2006 | Frazier |
| 2006/0283791 | A1 | 12/2006 | Ross |
| 2015/0240596 | A1 | 8/2015 | Horwell |
| 2017/0218722 | A1 | 8/2017 | Gordon |
| 2021/0396094 | A1 | 12/2021 | Taha |

* cited by examiner

CONTROLLING A WELLBORE FLUID FLOW

TECHNICAL FIELD

This disclosure relates to controlling a fluid flow in a wellbore, in particular, one through which hydrocarbons are produced.

BACKGROUND

Fluids, in the form of hydrocarbon and water, are trapped in reservoirs in subterranean formations. Wellbores are drilled through those subterranean formations to the reservoirs to flow the fluids to the surface of the Earth.

SUMMARY

This disclosure describes systems and methods related to controlling a wellbore fluid flow with a valve assembly. This approach positions the valve assembly in a wellbore, defining an annulus between the wellbore and the valve assembly. The valve assembly actuates a flow tube from a closed position preventing fluid flow from the annulus into the valve assembly to an open position allowing fluid flow from the annulus into the valve assembly responsive to a differential pressure within the valve assembly increasing to greater than or equal to a differential pressure threshold.

In one aspect, a valve assembly can control the wellbore fluid flow. The valve assembly includes a tubular, multiple flow paths through the tubular, a flow tube controlling the wellbore fluid flow, and an actuator sub-assembly coupled to and configured to actuate the flow tube. The tubular has an outer surface and an inner surface. The inner surface defines a void extending through the tubular along a longitudinal axis. The flow paths are fluidly coupled to the void and extend from the inner surface to the outer surface. The flow tube is slideably coupled to the outer surface. The flow tube is movable between a first position preventing a flow of fluid through the flow paths and a second position allowing the flow of fluid through the flow paths. The flow tube has a first end and a second end opposite the first end. The flow tube has a body extending from the inner surface of the flow tube and the body defines a shoulder. The flow tube has a support shroud protruding from the second end. The actuator sub-assembly is operably coupled to the flow tube. The actuator sub-assembly is configured to actuate the flow tube from the first position to the second position responsive to a differential pressure greater than or equal to a threshold differential pressure. The actuator sub-assembly includes a pressure cartridge, a burst disc, a retention shear ring, a retraction power spring, and a pressure chamber. The pressure chamber is defined by the outer surface of the tubular and the inner surface of the flow tube. The pressure chamber is configured to hold the pressure cartridge. The burst disc is positioned between the pressure cartridge and the void. The burst disc ruptures responsive to the differential pressure greater than or equal to the threshold differential pressure. The retention shear ring is coupled to the inner surface of the flow tube. The retention shear ring is held in place by a pressure of the pressure cartridge. The retraction power spring is coupled to the retention shear ring and the shoulder of the body of the flow tube. The retraction power spring is held in an energized position by the retention shear ring.

In some implementations, the flow tube includes a piston shroud protruding from a first end of the flow tube around a portion of the outer surface of the tubular. In some cases, the valve assembly includes multiple shear pins extending through the piston shroud of the flow tube and into the tubular. The shear pins secure the flow tube in the first position. The shear pins shear responsive to the actuator sub-assembly actuating the flow tube from the first position to the second position. Sometimes, the actuator sub-assembly has a port extending from the pressure chamber to the void and the burst disc is positioned in the port.

In some implementations, the pressure of the pressure cartridge is greater than or equal to 3,000 pounds per square inch.

In some implementations, the pressure cartridge includes a set of pressure cartridges. Each cartridge of the set of pressure cartridges has a different pressure. In some cases, the burst disc ruptures at a pressure of between 500 pounds per square inch differential and 3000 pounds per square inch differential.

In some implementations, when the pressure in the pressure cartridge decreases responsive to the burst disc bursting less than a second pressure threshold, a movement of the retention shear spring relative to the tubular is unconstrained, allowing the retraction power spring in the energized position to actuate to retracted position, initiating a movement of the flow tube from the first position to the second position.

In some implementations, the valve assembly includes a first connector on a first end of the tubular and a second connector on a second end of the tubular.

In some implementations, responsive to the flow tube moving to the second position allowing the flow of fluid through the flow paths, the flow of fluid is permitted between the void and a space outside the tubular.

In another aspect, a method for controlling a wellbore fluid flow includes disposing a completion assembly in a wellbore formed from a surface of the Earth to a subterranean reservoir. The completion assembly and the wellbore define an annulus. The method includes receiving a wellbore fluid at a pressure from a bottom hole opening of the completion assembly. The method includes flowing the wellbore fluid from the bottom hole opening through a void of the completion assembly in an uphole direction. The method includes, responsive to the pressure in the void being less than a first threshold pressure, moving a flow tube slideably coupled to an outer surface of the completion assembly to allow a fluid from the annulus into the void of the completion assembly.

In some implementations, moving the flow tube includes, responsive to the pressure of the wellbore fluid in the void less than the first threshold pressure, fracturing a burst disc separating a pressure chamber of the completion assembly from the void. The method can include, responsive to fracturing the burst disc, reducing a pressure of the pressure chamber less than a second pressure threshold. The method can include, responsive to reducing the pressure of the pressure chamber less than the second pressure threshold, moving the flow tube to allow the fluid from the annulus into the void.

In some cases, the method further includes maintaining the pressure of the pressure chamber at the second pressure threshold with a pressure cartridge until the burst disc ruptures.

In some cases, moving the flow tube to allow the fluid from the annulus into the void includes releasing a retention shear ring holding a retraction spring in an energized position. The method can include, responsive to releasing the retention shear spring, moving the retraction spring to a relaxed position. The method can include, responsive to moving the retraction spring to the relaxed position, moving the flow tube from a first position preventing a flow of fluid from the annulus into the void to a second position. When in the second position, the completion assembly allows the fluid from the annulus into the void.

In some cases, moving the flow tube to allow the fluid from the annulus into the void includes shearing multiple shear pins preventing a movement of the flow tube relative to the completion assembly, and responsive to shearing the shear pins, allowing a movement of the flow tube relative to the completion assembly.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1B:
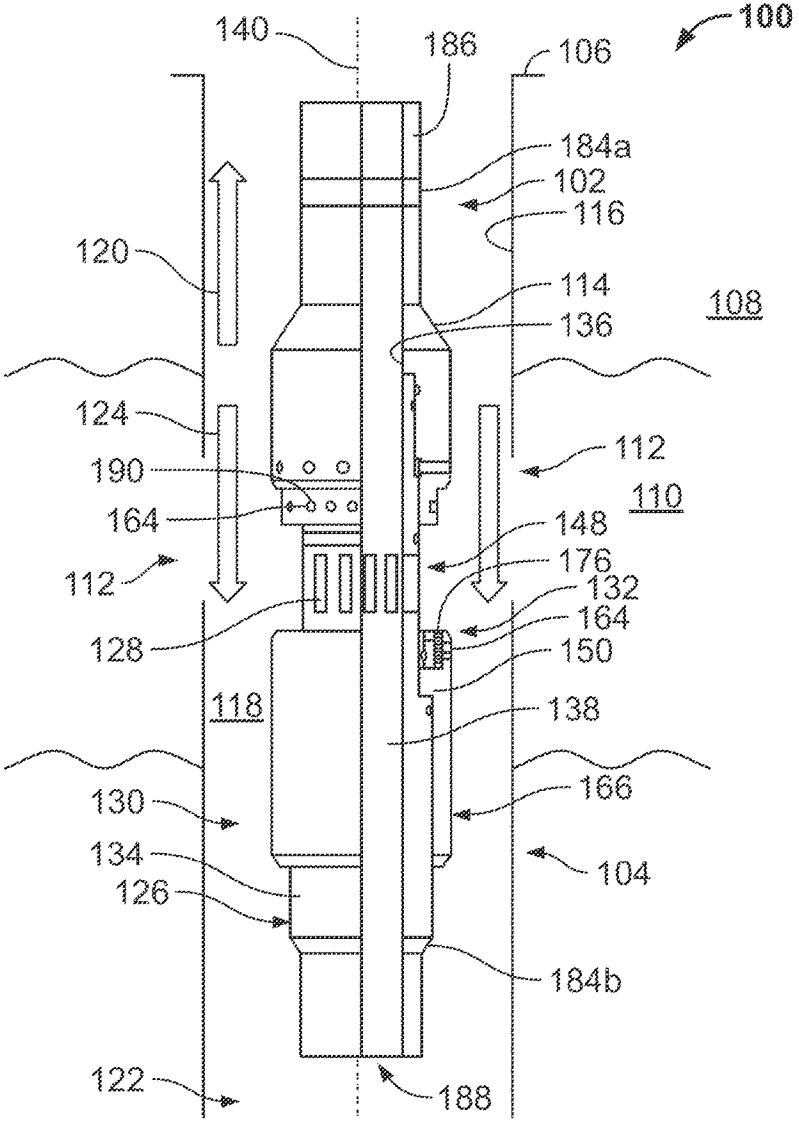
FIG. 1B is a schematic view of the delayed actuated annular drain valve of FIG. 1A with the flow tube in a second position.

The present disclosure relates to controlling a wellbore fluid flow with a valve assembly. This approach positions the valve assembly in a wellbore, defining an annulus between the wellbore and the valve assembly. The valve assembly actuates a flow tube from a closed position preventing fluid flow from the annulus into the valve assembly to an open position allowing fluid flow from the annulus into the valve assembly responsive to a differential pressure within the valve assembly increasing to greater than or equal to a differential pressure threshold.

The valve assembly has a tubular defining a void, flow paths fluidly coupled to the void through the tubular, a flow tube slideable between the first position and the second position to control the fluid flow, and an actuator sub-assembly to actuate the flow tube. The tubular has an outer surface and an inner surface. The void of the tubular is defined by the inner surface and extends through the tubular along a longitudinal axis. The flow paths extend from the inner surface to the outer surface and the flow paths are fluidly coupled to the void.

The flow tube is slideably coupled to the outer surface of the tubular and is movable between the first position preventing the fluid flow through the flow paths and the second position allowing the fluid flow through the flow paths. The flow tube has a body extending from the inner surface of the flow tube and the body defines a shoulder.

The actuator sub-assembly is operably coupled to the flow tube and actuates the flow tube from the first position to the second position responsive to a differential pressure greater than a threshold differential pressure. The actuator sub-assembly has a pressure cartridge, a burst disc, a retention shear ring, a retraction power spring, a pressure chamber, and a support shroud.

The burst disc is positioned between the pressure cartridge and the void. The burst disc ruptures responsive to the differential pressure greater than the threshold differential pressure. The retention shear ring is coupled to the inner surface of the flow tube. The retention shear ring is held in place responsive to a pressure of the pressure cartridge. The retraction power spring is coupled to the retention shear ring and the shoulder of the body of the flow tube. The retraction power spring is held in an energized position by the retention shear ring. The pressure chamber is defined by the outer surface of the tubular and the inner surface of the flow tube. The pressure chamber holds the pressure cartridge. The support shroud protrudes from a downhole end of the flow tube. The downhole end is opposite an uphole end. An inner surface of the support shroud further defines the pressure chamber.

Implementations of the present disclosure can realize one or more of the following advantages. These systems and methods can reduce or eliminate wellbore intervention operations. For example, the valve assembly can be, responsive to the differential pressure between the pressure cartridge and the void of the valve assembly increasing to greater than the differential pressure threshold, actuated the flow tube to allow the fluid in the annulus of the wellbore to flow through the flow paths and into the void of the valve assembly without a separate wellbore intervention operation from the surface.

These systems and methods can improve wellbore fluid control. For example, positioning multiple valve assemblies in a completion assembly in the wellbore, where each of the separate valve assemblies are at different depths in a wellbore corresponding to different portions of the wellbore proximal subterranean formations of different pressures, each of the valve assemblies can control a respective portion of fluid at different pressures from the different subterranean formations when the pressure in the pressure decreases less than a respective pressure threshold for each subterranean formation.

These systems and methods can reduce the complexity of a wellbore completion assembly. For example, multiple valve assemblies can allow multiple wellbore flows to co-mingle in the completion assembly.

These systems and methods can provide on-demand mutual flow path exclusivity elimination. For example, the delayed actuated annular drain valve can eliminate the mutually exclusive flow path between the production tubing and the annulus by introducing a flow path that allows the co-mingling of flow between the production tubing and the annulus. This can be achieved when the pressurized chamber encounters the threshold pressure differential to actuate the actuator sub-assembly, that is, the burst disc and subsequently movement of the retraction power spring. Once and/or as the shear pins fail, the retraction power spring can retract and slides the piston shroud of the flow tube to expose the flow path and the mutually exclusive flow path is eliminated on demand.

These systems and methods can enable transition between a natural-flow well to an assisted-flow well. For example, sometimes the differential pressure between the subterranean formation and the wellbore, and subsequently the internal void of the completion assembly enables the fluid contained in the subterranean formation to flow from the subterranean formation into the wellbore and the completion assembly (producing the subterranean formation). As the subterranean is produced, the pressure of the subterranean formation can decrease below a pressure threshold, slowing, stopping, or even reversing the direction of fluid flow. Opening a valve assembly controlling fluid flow from the annulus of the wellbore into the completion assembly in a different location in the wellbore can restore or assist the fluid flow from the subterranean formations into the wellbore.

These systems and methods can enhance operational efficiency. For example, reducing the quantity and complexity of completion operations required to produce the fluid from the subterranean formation can improve operational efficiency.

These systems and methods can allow for multiple deployments of valve assemblies in a single wellbore. For example, through utilization of a range of values of pressure cartridges, burst discs, retention shear rings, and retraction power springs multiple different valve assemblies can be positioned at different locations in the wellbore to control fluid flow from different subterranean formations at different pressures.

These systems and methods can improve efficiency of gas and liquid separation. For example, some fluid separation can occur through the flow paths of the valve assembly, increasing system separation efficiency.

These systems and methods can improve fluid co-mingling in a wellbore. For example, multiple fluid co-mingling paths can be arranged in a single production tubing to annulus scenario, where the subsequent (the next subsequent uphole or downhole location) co-mingling flow paths point needs to be actuated after an initial co-mingling point has been established. With a conventional annular drain valve without the pressure chamber and burst disc of the valve assembly, multiple flow paths cannot be established even by deploying multiple similar mechanisms because at the point of introducing the first flow co-mingling point, the annulus and tubing becomes pressure balanced, rendering interventionless actuation impossible. The delayed actuated annular drain valve allows for the interventionless actuation of multiple flow co-mingle points. The design of the flow co-mingling points can increase gas and liquid separation by the introduction of a flow path that leads to a velocity reduction, where separation of the gas and fluid, due to differing densities can occur.

Figure 1A:
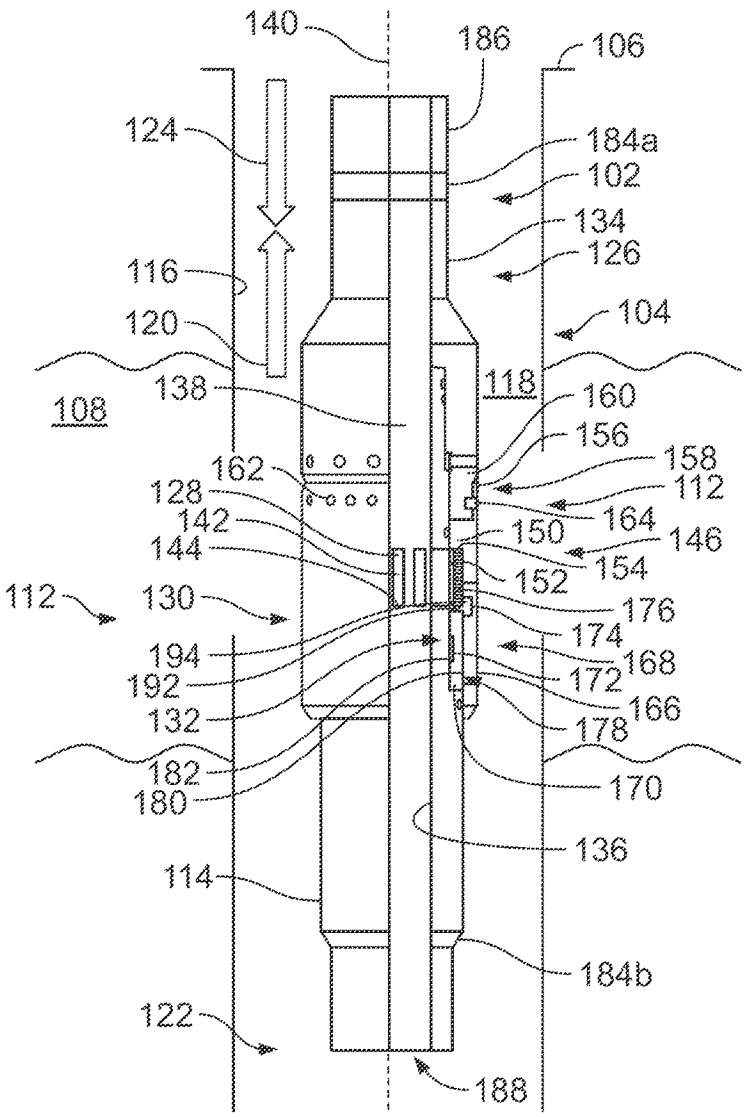
FIG. 1A is a schematic view of a delayed actuated annular drain valve installed in a wellbore with the flow tube in a first position.

FIG. 1A is a schematic view of a delayed actuated annular drain valve installed in a wellbore with the flow tube in a first position. FIG. 1B is a schematic view of the delayed actuated annular drain valve of FIG. 1A with the flow tube in a second position. The delayed actuated annular drain valve 100 (also referred to as valve assembly 100) controls a flow of fluid. The valve assembly 100 can be part of a completion assembly 102 positioned in a wellbore 104 drilled from a surface 106 of the Earth 108 to one or more subterranean geologic formations 110 (formations) containing fluids in the form of liquids and gases, including hydrocarbons and water. The fluid in the formations 110 are at a formation pressure. The completion assembly 102 conducts the fluid in the completion assembly 102 to the surface 106 of the Earth 108 for storage, refinement, and further downstream utilization. The wellbore 104 includes openings 112 such as perforations or an open bottom hole 190 through which the fluid from the formations 110 flow into the wellbore 104.

The completion assembly 102 has an outer surface 114. The wellbore 104 has an inner surface 116. The outer surface 114 of the completion assembly 102 and the inner surface 116 of the wellbore 104 define an annulus 118.

An uphole direction is in the direction of arrow 120 from a downhole location 122 toward the surface 106. A downhole direction is in the direction of arrow 124 from the surface 106 toward the downhole location 122.

The valve assembly 100 includes a tubular 126, multiple flow paths 128 extending through the tubular 126, a flow tube 130 slideably coupled to the tubular 126 to control fluid flow through the flow paths 128, and an actuator sub-assembly 132 to operate the flow tube 130. The actuator sub-assembly 132 actuates the flow tube 130 responsive to a differential pressure increasing greater than a threshold differential pressure.

The tubular 126 of the valve assembly 100 is a valve body. The tubular 126 has an outer surface 134 and an inner surface 136. When the valve assembly 100 is positioned in the wellbore 104, the outer surface 134 of the tubular 126 is exposed to the fluid in the wellbore 104. The outer surface 134 of the tubular 126 further defines the annulus 118. The inner surface 136 of the tubular 126 defines a void 138 in the interior of the tubular 126. Fluid from the wellbore 104 can flow through the void 138 of the tubular 126.

The tubular 126 has a longitudinal axis 140. In some cases, the void 138 is cylindrically shaped and the longitudinal axis 140 is the longitudinal axis 140 of the cylindrically shaped void 138.

The flow paths 128 extend from the inner surface 136 of the tubular 126 to the outer surface 134 of the tubular 126. The fluid from the wellbore 104 can pass from the annulus 118 of the wellbore 104 through the flow paths 128 into the void 138 of the valve assembly and mingle with any fluid present in the void 138. In other words, the flow paths 128 fluidly couple the annulus 118 (a space outside the tubular 126) of the wellbore 104 to the void 138 of the tubular 126. The flow paths 128 are sized and shaped to conduct fluid from the wellbore 104 into the void 138, that is, into the valve assembly 100.

The flow paths 128 define a cross-section 142. As shown in FIGS. 1A-1B, the cross-section 142 is generally rectangular with rounded corners 144. However, the cross-section 142 of the flow paths 128 can be one or more geometric or irregular shapes. For example, the cross-section 142 can be square-shaped, circle-shaped, oval-shaped, or irregularly shaped. The cross-section 142 can be uniform, increase, decrease, or vary between the outer surface 134 and the inner surface 136. The flow paths 128 can combine or branch between the outer surface 134 and the inner surface 136.

The flow tube 130 is slideably coupled to the outer surface 134 of the tubular 126 and controls the flow of fluid through the flow paths 128. Referring to FIG. 1A, the flow tube 130 is movable between a first position 146 preventing flow of fluid through the flow paths 128, and referring to FIG. 1B, a second position 148 offset from the first position 146 allowing the flow of fluid through the flow paths 128.

Referring to FIGS. 1A and 1B, the flow tube 130 has a body 150 extending from an inner surface 152 of the flow tube 130. The body 150 defines a shoulder 154.

The flow tube 130 has a piston shroud 156 protruding from a first end 158 of the flow tube 130 around a portion 160 of the outer surface 134 of the tubular 126. The piston shroud 156 sealably engages the portion 160 of the outer surface 134 of the tubular 126. The piston shroud 156 has voids 162 extending through the piston shroud 156. The voids 162 are sized to receive shear pins 164.

The shear pins 164 extend through the voids 162 of the piston shroud 156 and into another void 190 in the flow tube 130 to retain the flow tube 130 in the first position 146 preventing the fluid from the wellbore 104 flowing into the flow paths 128. The shear pins 164 shear (fail) relative to a force acting on the flow tube 130 to move the flow tube 130 from the first position 146 to the second position 148. The shear pins 164 are sized to retain the flow tube 130 in the first position 146. The shear pins 164 are a metal. For example, the shear pins 164 can be a steel or a steel alloy.

The flow tube 130 has a support shroud 166 protruding from a second end 168 of the flow tube 130. The second end 168 is opposite the first end 158.

The actuator sub-assembly 132 is operably coupled to the flow tube 130 to actuate the flow tube 130 from the first position 146 to the second position 148. The actuator sub-assembly 132 actuates the flow tube 130 from the first position 146 to the second position 148 responsive to a differential pressure greater than a threshold differential pressure. The actuator sub-assembly 132 includes a pressure cartridge 170, a burst disc 172, a retention shear ring 174, a retraction power spring 176, and a pressure chamber 178. The pressure cartridge 170, the burst disc 172, the retention shear ring 174, and the retraction power spring 176 actuate to move the flow tube 130 from the first position 146 to the second position 148.

The pressure cartridge 170 is placed in the pressure chamber 178. The pressure cartridge 170 contains a pressurized fluid such as a gas or liquid. In some cases, the pressure of the fluid in the pressure cartridge 170 is greater than or equal to 3,000 pounds per square inch.

In some implementations, the pressure cartridge 170 is included in a set of pressure cartridges 170. In the set of pressure cartridges 170, each pressure cartridge 170 of the set can have different pressures. For example, one pressure cartridge 170 can have a pressure of 1500 pounds per square inch, another pressure cartridge 170 can have a pressure of 1750 pounds per square inch, yet another can have a pressure of 2000 pounds per square inch, a different pressure cartridge 170 can have a pressure of 3000 pounds per square inch, and another can have a pressure of 4000 pounds per square inch. The set of pressure cartridges 170 can include some or all of the pressure cartridges 170 at the same or similar pressure. The pressure of the pressure cartridge 170 is one of the criteria used to determine the differential pressure threshold at which the burst disc 172 bursts. A user can select and install a particular pressure cartridge 170 in the valve assembly 100 based on the planned depth within the wellbore 104 at which the valve assembly 100 will be positioned and based on the formation 110 pressure at the planned depth.

The pressure chamber 178 is defined by the outer surface 134 of the tubular 126 and the inner surface 152 of the flow tube 130 to hold the pressure cartridge 170. The support shroud 168 has an inner surface 180 which further defines the pressure chamber 178. The user installs the pressure cartridge 170 in the pressure chamber 178.

The burst disc 172 is positioned between the pressure cartridge 170 in the pressure chamber 178 and the void 138. The burst disc 172 is configured to rupture (burst, fracture, or break) responsive to the differential pressure greater than or equal to the threshold differential pressure across the burst disc 172, that is, between the pressure cartridge 170 and the void 138. The burst disc 172 is placed in a port 182 in the inner surface 136 of the flow tube 130 between the pressure chamber 178 and the void 138.

Physical properties of the burst disc 172 determine the differential pressure at which the burst disc 172 factures and bursts. For example, a width of the burst disc 172 (the dimension of the burst disc 172 between the pressure cartridge 170 and the void 138) is one factor which can determine the differential pressure at which the burst disc 172 bursts. A larger width of the burst disc 172 can increase the differential pressure at which the burst disc 172 bursts. A smaller width of the burst disc can decrease the differential pressure at which the burst disc 172 bursts. A material from which the burst disc 172 is constructed is another factor which can determine the differential pressure at which the burst disc 172 bursts. For example, a material with a higher or lower fracture toughness, yield strength, or other material property can determine the differential pressure at which the burst disc 172 bursts. Another factor which can determine the differential pressure at which the burst disc 172 bursts can be physical features (not shown). In some cases, the pressure differential at which the burst discs 172 can burst can range from between 500-3000 pounds per square inch differential. In some cases, where multiple valve assemblies 100 are used in the completion assembly 102, the pressure differentials in the different burst discs 172 can be in 250 pounds per square inch to allow for multiple staggered deployments in a single wellbore 104. Alternative ranges and intervals can be selected depending on specific wellbore 104 requirements.

Each delayed actuated annular drain valve 100 can be pre-set with the individual desired burst disc 172 pressure ratings to allow for the deployment of multiple drain valves 100 in a single wellbore 104. This can allow for the precise placement of the delayed actuated annular drain valve 100 anywhere along the completion assembly 102 to facilitate the placement of fluid co-mingling points. The fluid co-mingling points throughout the wellbore 104 can be enabled through the individualized rating of each valve assembly 100.

In some implementations, the burst disc 172 is included in a set of burst discs 172. In the set of burst discs 172, each burst disc 172 of the set can have different differential pressure thresholds. For example, one burst disc 172 can burst at a differential pressure of 100 pounds per square inch differential, another burst disc 172 can burst at a differential pressure of 250 pounds per square inch differential, and yet another can burst at a differential pressure of 500 pounds per square inch differential. The set of burst discs 172 can include some or all of the burst disc 172 which burst at the same or similar differential pressure. A user can select and install a particular burst disc 172 in the valve assembly 100 based on the planned depth within the wellbore 104 at which the valve assembly 100 will be positioned and based on the formation 110 pressure at the planned depth.

The burst disc 172, when installed in the valve assembly 100, can be prevented from bursting by a burst disc actuation prevention fixture (not shown). The burst disc actuation prevention fixture can be used to prevent the actuation of the burst disc 172 when the burst disc 172 is exposed to a pressure less than the threshold pressure, that is, even when the differential pressure across the burst disc 172 is greater or equal than the differential pressure threshold. For example, when the valve assembly 100 is being assembled in the surface 106 (the pressure is at atmospheric pressure) or placed in the wellbore 104 (the valve assembly is in the wellbore 104 and not yet at the planned location and/or the pressure is less than the pressure at the planned location in the wellbore 104). The burst disc actuation prevention fixture can be removed after the valve assembly 100 is at the planned location in the wellbore 104.

The retention shear ring 174 of the actuator sub-assembly 132 is coupled to the inner surface 136 of the flow tube 130 and holds the retraction power spring 176 in an energized (compressed) position. The retention shear ring 174 is held in place by the pressure of the pressure cartridge 170 in the pressure chamber 178. The retraction power spring 176 rests in the shoulder 154 of the flow tube 130 and the retention shear ring 174. After the burst disc 172 bursts releasing the pressure in the pressure cartridge 170, the retention shear ring 174 is free to move, and the retraction power spring 176 extends from the energized (compressed) position to a relaxed position, pushing the retention shear ring 174 and the flow tube 130, moving the flow tube 130 in the downhole direction 124 from the first position 146 to the second position 148. In other words, responsive to the pressure in the pressure cartridge 170 decreasing responsive to the burst disc 172 bursting less than a second pressure threshold, a movement of the retention shear ring 174 relative to the tubular 126 is unconstrained, allowing the retraction power spring 176 in the energized position to actuate to the relaxed position, initiating a movement of the flow tube 130 from the first position 146 to the second position 148.

In some cases, when the shear pins 164 shear and the retention shear ring 176 moves, the retention shear ring 176 is retracted along with the flow tube 130. The retention shear ring 176 can retain the retraction power spring 146 with a ridge 192, which interacts with a pre-machined notch 194. When the shear pins 164 fail, a portion of the shear pins 164 remain intact in the voids 162 of the piston shroud 156 as the flow tube 130 parts from the tubular 126 as the flow tube 130 retracts with the support shroud 156, and another portion of the shear pins 164 remain in the voids 190 in the tubular 126.

In some implementations, the retraction power spring 176 is included in a set of retraction power springs 176. In the set of retraction power springs 176, each retraction power spring 176 of the set can have spring constant. A user can select and install a particular retraction power spring 176 in the valve assembly 100.

The retention shear ring 174 and retraction power spring 176 can be designed and engineered with the mechanical features to move the flow tube 130 responsive to the burst disc 172 bursting. The retraction power spring 176 can be sized such that a retraction force of the retraction power spring 176 is greater that a force required to part the shear pins 164. The shear pins 164 can have dimensions such that the retention forces required to part the shear pins 164 is less than the retraction force exerted by the retraction power spring 176.

The valve assembly 100 includes connectors, such as a first connector 184*a* on the first end 158 end of the tubular 126 and a second connector 184*b* on a second end 168 of the tubular 126. The connectors 184*a*, 184*b* can couple to other components of the completion assembly 102 such as production tubulars 186 or other valve assemblies 100. For example, the connectors 184*a*, 184*b* can be a rotary shouldered connection. For example, the connectors 184*a*, 184*b* can be a standard API (American Petroleum Institute) pin connection used to attach the valve assembly 100 to the completion assembly 102. The standard API rotary shouldered connection is a regular connection, a numeric connection, an internal flush connection, or a full hole connection. The pin connection is manufacturer proprietary design. For example, the connectors 184*a*, 184*b* can be a box connection, where the threads are internal to the box. The connectors 184*a*, 184*b* can have an outer diameter corresponding to a standard American Petroleum Institute connection size. For example, the connectors 184*a*, 184*b* can have an outer diameter of 2⅜ inches, 2⅞ inches, 3½ inches, 4½ inches, 5½ inches, 6⅝ inches, 7⅝ inches, or 8⅝ inches.

The one of production tubulars 186 of completion assembly 102 has a bottom hole opening 188 to the void 138 at the downhole location 122. Fluids from the wellbore 104 can flow through the bottom hole opening 188 and into the void 138 to the surface 106.

In some implementations, not shown, the completion assembly 102 can include multiple delayed actuated annular drain valves 100, that is, multiple valve assemblies 100 spaced apart such that one or more valve assemblies 100 are positioned proximal different formations 110 at different depths in the wellbore 104. For example, the completion assembly 102 can include two, three, seven, or more valve assemblies 100. In some implementations, valve assemblies can be positioned in multiple lateral wellbores of a multilateral well system. In some implementations, the valve assemblies 100 can be positioned in series, parallel, or combinations of series and parallel throughout the completion assembly 102 with similar or differing burst pressures.

Figure 2:
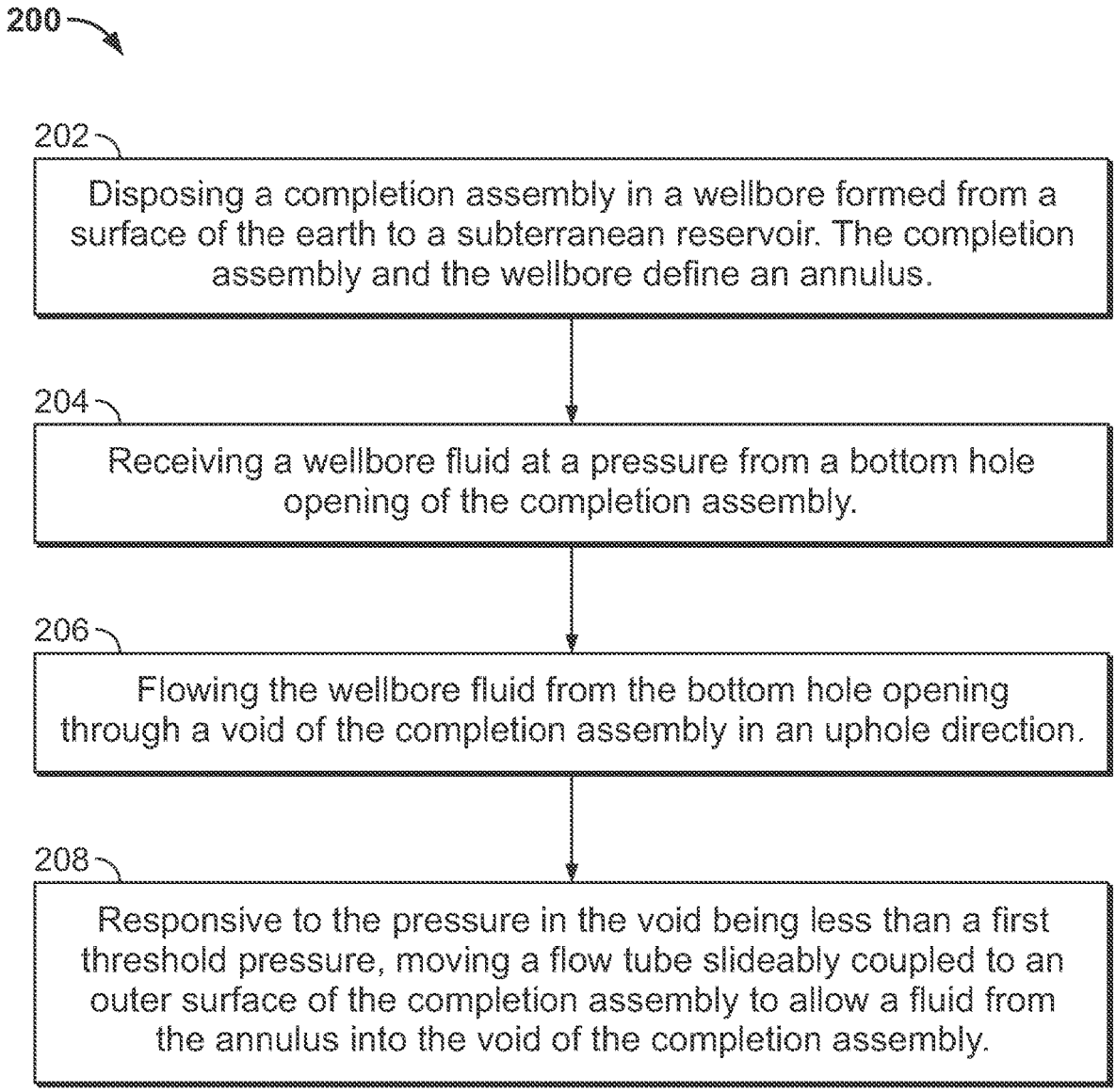
FIG. 2 is a flow chart of an example method of controlling a wellbore fluid flow with a valve assembly.

FIG. 2 is a flow chart 200 of an example method of controlling a wellbore fluid flow according to the implementations of the present disclosure. At 202, a completion assembly is disposed in a wellbore formed from a surface of the Earth to a subterranean reservoir. The completion assembly and the wellbore defining an annulus. For example, the completion assembly 102 can be positioned in the wellbore 104, defining the annulus 118. Fluid flows from the formations 110 through the openings 112 in the wellbore 104 and into the annulus 118.

At 204, a wellbore fluid at a pressure is received from a bottom hole opening of the completion assembly. For example, the fluid in the formation 110 is at the formation pressure. The fluid flows into the annulus 118 to the bottom hole opening 188 of the completion assembly 102.

At 206, the wellbore fluid is flowed from the bottom hole opening through a void of the completion assembly in an uphole direction. For example, the fluid flows from the bottom hole opening 188 of the completion assembly 102 in the uphole direction 120 through the void 138.

At 208, responsive to the pressure in the void being less than a first threshold pressure, a flow tube slideably coupled to an outer surface of the completion assembly is moved to allow a fluid from the annulus into the void of the completion assembly. For example, responsive to the pressure of the fluid in the void 138 less than a threshold pressure causing the actuator sub-assembly 132 to move the flow tube 130 to allow fluid to flow from the annulus 118 into the void 138 of the valve assembly 100.

In some implementations, moving the flow tube includes responsive to the pressure of the wellbore fluid in the void less than the first threshold pressure, fracturing a burst disc separating a pressure chamber of the completion assembly from the void; responsive to fracturing the burst disc, reducing a pressure of the pressure chamber less than a second pressure threshold; and responsive to reducing the pressure of the pressure chamber less than the second pressure threshold, moving the flow tube to allow the fluid from the annulus into the void. For example, responsive to the pressure in void 138 decreasing such that differential pressure across the burst disc 172 increases greater than a differential pressure threshold, the burst disc 172 bursts, releasing the compressed gas from the pressure cartridge 170, and the flow tube 130 moves from the first position 146 to the second position 148.

In some implementations, controlling the fluid flow in the wellbore includes maintaining the pressure of the pressure chamber at the second pressure threshold with a pressure cartridge until the burst disc bursts. For example, the pressure in the pressure chamber 178 at or above a second pressure threshold prevents the actuator sub-assembly 132 from actuating. The pressure in the pressure chamber 178 can be the pressure of the pressure cartridge 170. The pressure cartridge 170 is held in the pressure chamber 178.

Responsive to the burst disc 172 bursting, the pressure cartridge 170 in the pressure chamber 178 releases the pressurized gas through the port 185 into the void 138.

In some implementations, moving the flow tube to allow the fluid from the annulus into the void includes releasing a retention shear ring holding a retraction power spring in an energized position; responsive to releasing the retention shear spring, moving the retraction power spring to a relaxed position; and responsive to moving the retraction power spring to the relaxed position, moving the flow tube from a first position preventing a flow of fluid from the annulus into the void to a second position. When the flow tube is in the second position, the completion assembly allows the fluid from the annulus into the void. For example, the retention shear ring 174 is held in place by the pressure of the pressure cartridge 170. Responsive to the burst disc 172 bursting, the pressure in pressure chamber 178 decreases less than the second pressure threshold, and the retention shear ring 174 is released to move, and assisted by the retraction power spring 176, moves the flow tube 130 from the first position 146 to the second position 148.

In some implementations, moving the flow tube to allow the fluid from the annulus into the void includes shearing multiple shear pins preventing a movement of the flow tube relative to the completion assembly; and responsive to shearing multiple shear pins, allowing a movement of the flow tube relative to the completion assembly. For example, responsive to the burst disc 172 bursting, the pressure in pressure chamber 178 decreases less than the second pressure threshold, and the retraction power spring 176 moves the flow tube 130, shearing the shear pins 164, allowing the flow tube 130 to move from the first position 146 to the second position 148.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The invention claimed is:

1. A valve assembly comprising:

a tubular having an outer surface and an inner surface, the inner surface defining a void extending through the tubular along a longitudinal axis;

a plurality of flow paths fluidly coupled to the void extending from the inner surface to the outer surface;

a flow tube slideably coupled to the outer surface, the flow tube movable between a first position preventing a flow of fluid through the plurality of flow paths and a second position allowing the flow of fluid through the plurality of flow paths, the flow tube comprising:

a first end and a second end opposite the first end;

a body extending from the inner surface of the flow tube, the body defining a shoulder; and a support shroud protruding from the second end; and an actuator sub-assembly operably coupled to the flow tube, the actuator sub-assembly configured to actuate the flow tube from the first position to the second position responsive to a differential pressure greater than or equal to a threshold differential pressure, the actuator sub-assembly comprising:

a pressure cartridge;

a burst disc positioned between the pressure cartridge and the void, the burst disc configured to rupture responsive to the differential pressure greater than or equal to the threshold differential pressure;

a retention shear ring coupled to the inner surface of the flow tube, the retention shear ring held in place by a pressure of the pressure cartridge;

a retraction power spring coupled to the retention shear ring and the shoulder of the body of the flow tube, the retraction power spring held in an energized position by the retention shear ring; and a pressure chamber defined by the outer surface of the tubular and the inner surface of the flow tube, the pressure chamber configured to hold the pressure cartridge.

2. The valve assembly of claim 1, wherein the flow tube further comprises a piston shroud protruding from the first end of the flow tube around a portion of the outer surface of the tubular.

3. The valve assembly of claim 2, further comprising a plurality of shear pins extending through the piston shroud of the flow tube and into the tubular, the plurality of shear pins securing the flow tube in the first position, the plurality of shear pins configured to shear responsive to the actuator sub-assembly actuating the flow tube from the first position to the second position.

4. The valve assembly of claim 3, wherein the actuator sub-assembly comprises a port extending from the pressure chamber to the void, the burst disc positioned in the port.

5. The valve assembly of claim 1, wherein the pressure of the pressure cartridge is greater than or equal to 3,000 pounds per square inch.

6. The valve assembly of claim 1, wherein the pressure cartridge comprises a set of pressure cartridges, each cartridge of the set of pressure cartridges having a different pressure.

7. The valve assembly of claim 6, wherein the burst disc ruptures at a pressure of between 500 pounds per square inch differential and 3000 pounds per square inch differential.

8. The valve assembly of claim 1, wherein when the pressure in the pressure cartridge decreases responsive to the burst disc bursting less than a second pressure threshold, movement of the retention shear spring relative to the tubular is unconstrained, allowing the retraction power spring in the energized position to actuate to retracted position, initiating movement of the flow tube from the first position to the second position.

9. The valve assembly of claim 1, further comprising:

a first connector on a first end of the tubular; and a second connector on a second end of the tubular.

10. The valve assembly of claim 1, wherein responsive to the flow tube moving to the second position allowing the flow of fluid through the plurality of flow paths, the flow of fluid is permitted between the void and a space outside the tubular.

11. A method for controlling a wellbore fluid flow, the method comprising:

disposing a completion assembly in a wellbore formed from a surface of the Earth to a subterranean reservoir, the completion assembly and the wellbore defining an annulus;

receiving a wellbore fluid at a pressure from a bottom hole opening of the completion assembly;

flowing the wellbore fluid from the bottom hole opening through a void of the completion assembly in an uphole direction; and responsive to the pressure in the void being less than a first threshold pressure, moving a flow tube slideably coupled to an outer surface of the completion assembly to allow a fluid from the annulus into the void of the completion assembly, wherein moving the flow tube comprises:

responsive to the pressure of the wellbore fluid in the void less than the first threshold pressure, fracturing a burst disc separating a pressure chamber of the completion assembly from the void;

responsive to fracturing the burst disc, reducing a pressure of the pressure chamber less than a second pressure threshold; and responsive to reducing the pressure of the pressure chamber less than the second pressure threshold, moving the flow tube to allow the fluid from the annulus into the void.

12. The method of claim 11, further comprising maintaining the pressure of the pressure chamber at the second pressure threshold with a pressure cartridge until the burst disc ruptures.

13. The method of claim 11, wherein moving the flow tube to allow the fluid from the annulus into the void comprises:

releasing a retention shear ring holding a retraction spring in an energized position;

responsive to releasing the retention shear spring, moving the retraction spring to a relaxed position; and responsive to moving the retraction spring to the relaxed position, moving the flow tube from a first position preventing a flow of fluid from the annulus into the void to a second position, wherein when in the second position, the completion assembly allows the fluid from the annulus into the void.

14. The method of claim 11, moving the flow tube to allow the fluid from the annulus into the void comprises:

shearing a plurality of shear pins preventing movement of the flow tube relative to the completion assembly; and responsive to shearing the plurality of shear pins, allowing movement of the flow tube relative to the completion assembly.

* * * * *